US006887526B1

(12) United States Patent
Arlt et al.

(10) Patent No.: US 6,887,526 B1
(45) Date of Patent: May 3, 2005

(54) INTEGRATED COATING METHOD FOR AUTO BODY PARTS CONTAINING PLASTIC PARTS OR FOR CABINS OF PASSENGER CARS AND UTILITY VEHICLES AS WELL AS FOR THEIR REPLACEMENT PARTS AND ADD-ON PARTS

(75) Inventors: Klaus Arlt, Senden (DE); Bernd Mayer, Münster (DE); Franz-Josef Wylegalla, Münster (DE); Norbert Zdahl, Ascheberg (DE)

(73) Assignee: BASF Coatings AG, Munster (DE)

( * ) Notice: Subject to any disclaimer, the term of this patent is extended or adjusted under 35 U.S.C. 154(b) by 344 days.

(21) Appl. No.: 10/049,224

(22) PCT Filed: Aug. 25, 2000

(86) PCT No.: PCT/EP00/08298

§ 371 (c)(1),
(2), (4) Date: Feb. 7, 2002

(87) PCT Pub. No.: WO01/19531

PCT Pub. Date: Mar. 22, 2001

(30) Foreign Application Priority Data

Sep. 16, 1999 (DE) ..... 199 44 483

(51) Int. Cl.[7] ..... B05D 1/36

(52) U.S. Cl. ..... 427/407.1; 427/409; 427/372.2; 427/388.2; 428/423.1; 428/423.3; 428/414; 428/425.8

(58) Field of Search ..... 427/407.1, 409, 427/372.2, 388.2; 428/423.1, 423.3, 414, 425.8

(56) References Cited

U.S. PATENT DOCUMENTS

| | | | | |
|---|---|---|---|---|
| 3,361,844 A | | 1/1968 | Hoeschele et al. | 260/858 |
| 3,922,253 A | | 11/1975 | Jerabek et al. | 260/77.5 TB |
| 4,172,822 A | | 10/1979 | Patzschke | 525/424 |
| 4,444,954 A | * | 4/1984 | Mels et al. | 525/124 |
| 4,458,054 A | | 7/1984 | Schmözer et al. | 525/327.3 |
| 4,489,135 A | | 12/1984 | Drexler et al. | 428/423.1 |
| 4,710,542 A | | 12/1987 | Forgione et al. | 525/127 |
| 4,711,937 A | | 12/1987 | Paar | 525/489 |
| 4,756,975 A | | 7/1988 | Fujii et al. | 428/461 |
| 4,808,658 A | | 2/1989 | Walz et al. | 524/591 |
| 4,851,460 A | | 7/1989 | Stranghöner et al. | 523/407 |
| 4,865,704 A | | 9/1989 | Saatweber et al. | 204/181 |
| 4,880,867 A | | 11/1989 | Gobel et al. | 524/507 |
| 4,914,148 A | | 4/1990 | Hille et al. | 524/507 |
| 4,939,213 A | | 7/1990 | Jacobs, III et al. | 525/329.9 |
| 4,945,128 A | | 7/1990 | Hille et al. | 524/591 |
| 5,021,502 A | | 6/1991 | Patzschke et al. | 524/591 |
| 5,039,720 A | | 8/1991 | Saatweber et al. | 523/404 |
| 5,075,372 A | | 12/1991 | Hille et al. | 524/839 |
| 5,084,541 A | | 1/1992 | Jacobs, III et al. | 528/45 |
| 5,101,000 A | | 3/1992 | Paar et al. | 528/111 |
| 5,109,040 A | | 4/1992 | Hönig et al. | 523/411 |
| 5,210,154 A | | 5/1993 | Weidemeier et al. | 525/438 |
| 5,252,399 A | | 10/1993 | Hirata et al. | 428/416 |
| 5,264,497 A | | 11/1993 | Hönig et al. | 525/453 |
| 5,334,420 A | | 8/1994 | Hartung et al. | 427/407.1 |
| 5,342,882 A | | 8/1994 | Göbel et al. | 524/832 |
| 5,368,944 A | | 11/1994 | Hartung et al. | 428/423.1 |
| 5,370,910 A | | 12/1994 | Hille et al. | 427/407.1 |
| 5,389,406 A | | 2/1995 | Doebler et al. | 427/407.1 |
| 5,418,264 A | | 5/1995 | Obloh et al. | 523/414 |
| 5,569,705 A | | 10/1996 | Vogt-Birnbrich et al. | 524/591 |
| 5,571,861 A | | 11/1996 | Klein et al. | 524/591 |
| 5,601,880 A | | 2/1997 | Schwarte et al. | 427/407.1 |
| 5,654,391 A | | 8/1997 | Göbel et al. | 528/71 |
| 5,691,425 A | | 11/1997 | Klein et al. | 525/455 |
| 5,707,941 A | | 1/1998 | Häberle | 528/44 |
| 5,760,128 A | | 6/1998 | Baltus et al. | 524/591 |
| 6,001,424 A | | 12/1999 | Lettmann et al. | 427/407.1 |
| 6,291,564 B1 | * | 9/2001 | Faler et al. | 524/284 |
| 6,372,875 B1 | | 4/2002 | Mayer et al. | 528/60 |

FOREIGN PATENT DOCUMENTS

| | | |
|---|---|---|
| CA | 2104845 | 8/1993 |
| CA | 2073115 | 8/2001 |
| CA | 2078650 | 8/2001 |
| CA | 2102170 | 8/2001 |
| CA | 2127761 | 8/2001 |
| DE | 1 793 785 | 12/1964 |
| DE | 1 618 795 | 4/1972 |
| DE | 33 24 211 A1 | 1/1985 |
| DE | 28 24 418 C2 | 8/1990 |
| DE | 43 28 092 A1 | 2/1995 |
| EP | 082 291 B1 | 11/1982 |
| EP | 89 497 A2 | 2/1983 |
| EP | 178 531 A1 | 10/1985 |
| EP | 227 975 A1 | 12/1986 |
| EP | 228 003 A1 | 12/1986 |

(Continued)

OTHER PUBLICATIONS

English Langugae Abstract Cover Page Of The International Publication WO96/12747.
English Language Abstract DE 43 28 092 A1.
English Language Abstract Cover Page Of The International Publication WO95/14721.
English Abstract Cover Page Of The International Publication WO91/12899.
English Language Abstract EP 436 941.
English Language Abstract EP 260 447.
English Language Abstract 297 576.
English Language Abstract DE 33 24 211.
English Language Abstract EP 0 436 941 A1.

*Primary Examiner*—James J. Seidleck
*Assistant Examiner*—Melanie Bissett

(57) ABSTRACT

A process for painting integrated automobile and commercial vehicle bodies or cabins which comprise plastic parts. The metal parts of the body/cabin are provided with an electrocoat and are integrated with the plastic parts. These plastic parts either already have an electrically conductive aqueous primer coat or an uncured electrically conductive aqueous primer film or are unpainted. Primers are applied to the metal and plastic parts. Atop the primers, a basecoat and a clearcoat are applied.

18 Claims, No Drawings

FOREIGN PATENT DOCUMENTS

| | | | |
|---|---|---|---|
| EP | 234 361 | A1 | 2/1987 |
| EP | 234 362 | A1 | 2/1987 |
| EP | 234 395 | B1 | 2/1987 |
| EP | 245 700 | A2 | 4/1987 |
| EP | 245 786 | A2 | 5/1987 |
| EP | 256 540 | A2 | 8/1987 |
| EP | 260 447 | A2 | 8/1987 |
| EP | 261 385 | A2 | 8/1987 |
| EP | 299 148 | A2 | 4/1988 |
| EP | 297 576 | A1 | 6/1988 |
| EP | 354 261 | A1 | 8/1988 |
| EP | 310 971 | A2 | 9/1988 |
| EP | 333 327 | A1 | 2/1989 |
| EP | 339 433 | A3 | 4/1989 |
| EP | 397 806 | B1 | 7/1989 |
| EP | 394 737 | A1 | 4/1990 |
| EP | 401 565 | A1 | 5/1990 |
| EP | 414 199 | A2 | 8/1990 |
| EP | 424 705 | A2 | 10/1990 |
| EP | 436 941 | A1 | 12/1990 |
| EP | 436 941 | | 12/1990 |
| EP | 517 707 | B1 | 1/1991 |
| EP | 543 817 | B1 | 2/1991 |
| EP | 521 928 | B1 | 3/1991 |
| EP | 593 454 | B1 | 3/1991 |
| EP | 456 270 | A1 | 5/1991 |
| EP | 476 514 | A1 | 9/1991 |
| EP | 574 417 | B1 | 2/1992 |
| EP | 531 510 | | 3/1992 |
| EP | 522 419 | A1 | 6/1992 |
| EP | 522 420 | A2 | 6/1992 |
| EP | 523 610 | A1 | 7/1992 |
| EP | 536 712 | A2 | 10/1992 |
| EP | 581 211 | B1 | 7/1993 |
| EP | 584 818 | B1 | 8/1993 |
| EP | 590 484 | A1 | 9/1993 |
| EP | 596 460 | A2 | 11/1993 |
| EP | 596 461 | B1 | 11/1993 |
| EP | 624 577 | A1 | 5/1994 |
| EP | 708 788 | B1 | 6/1994 |
| EP | 634 431 | A1 | 7/1994 |
| EP | 649 865 | B1 | 10/1994 |
| EP | 730 613 | B1 | 11/1994 |
| EP | 669 356 | A1 | 2/1995 |
| EP | 678 536 | A1 | 4/1995 |
| EP | 44 14 032 | A1 | 10/1995 |
| GB | 1127338 | | 6/1967 |
| GB | 1220717 | | 3/1971 |
| WO | WO95/14721 | | 6/1995 |
| WO | WO96/12747 | | 5/1996 |
| WO | WO97/49745 | | 12/1997 |
| WO | WO97/49747 | | 12/1997 |
| ZA | 84/5117 | | 1/1985 |

* cited by examiner

INTEGRATED COATING METHOD FOR AUTO BODY PARTS CONTAINING PLASTIC PARTS OR FOR CABINS OF PASSENGER CARS AND UTILITY VEHICLES AS WELL AS FOR THEIR REPLACEMENT PARTS AND ADD-ON PARTS

This application is a National Phase Application of Patent Application PCT/EP00/08298 filed on Aug. 25, 2000.

The present invention relates to a new integrated painting process for automobile and commercial vehicle bodies or cabins and their replacement parts and add-on parts which comprise plastic parts (i.e., parts made of plastic). The present invention further relates to the automobile and commercial vehicle bodies or cabins and their replacement parts and add-on parts that have been coated by means of the new integrated painting process.

With few exceptions, the bodies or cabins of automobiles and commercial vehicles, especially trucks and buses, consisting predominantly of galvanized steel, are painted worldwide by the following process:

1) phosphating of the steel surface;
2) coating with a cathodic electrocoat material and baking the electrocoat film to give the corrosion protection electrocoat;
3) application of a surfacer and baking of the resulting surfacer film to give the energy-absorbing surfacer or antistonechip primer coat;
4) application of a basecoat material, especially an aqueous basecoat material, to give a basecoat film;
5) drying of the basecoat film;
6) application of a clearcoat material to give a clearcoat film; and
7) joint heat curing of the basecoat film and clearcoat film to give the multicoat color and/or effect paint system (wet-on-wet technique).

This process gives multicoat systems of outstanding chemical resistance and weathering stability, affording outstanding protection against corrosion and exhibiting an outstanding overall visual impression.

The plastics and plastic parts that are presently available for the manufacture of automobiles and commercial vehicles are unable to undergo the painting process employed in the automobile industry on account of the fact that, at the baking or curing temperatures of more than 90° C. which are employed in the process, they are deformed. It is therefore necessary to carry out separate, i.e., offline, painting of all plastic parts for later mounting on the bodies or cabins, using paints whose curing characteristics and other properties must be adapted to the plastics. Consequently, there is also a great deal of effort involved in adapting the color of the coating on the plastic parts to the color of the coating on the metal parts.

The automobile industry is therefore attempting to eliminate the color problem from the outset by means of what is known as online or inline painting.

Online painting is the painting process in which the plastic parts, following application and the baking of the surfacer, are joined to the metal parts of the respective autobody or commercial vehicle cabin on its assembly stage (skid) and are then jointly topcoated.

Inline painting is the painting process in which the plastic parts are attached after the metal parts have been electrocoated and before the surfacer has been applied, on the skid of the respective autobody or commercial vehicle cabin, after which the whole assembly has a generally complete, uniform paint finish.

These approaches, although advantageous for themselves, frequently fail on account of the fact that, when cured at temperatures below 100° C., the thermosetting coating materials commonly employed to date have been unable to meet customer specifications, particularly with regard to corrosion protection, stonechip resistance, and condensation resistance.

It is an object of the present invention to find a new integrated process for painting automobile and commercial vehicle bodies and cabins and their replacement parts and add-on parts which comprise plastic parts, said process no longer having the disadvantages of the prior art but instead giving bodies of automobile commercial vehicles, especially commercial vehicle cabins, which have a uniform color and which meet all of the market requirements in terms of their overall visual appearance, their corrosion protection, and their resistance to stonechipping, chemicals, weathering and condensation. In particular, the multicoat color and/or effect paint systems produced by the new integrated processes are to exhibit very good resistance in the high-pressure cleaner test following moisture exposure, and a high stonechip resistance even at −20° C.

What has been found, accordingly, is the novel integrated process for painting automobile and commercial vehicle bodies and cabins and their replacement parts and add-on parts which comprise plastic parts, wherein 1) the metal parts of the body or cabin and/or their replacement parts or add-on parts are coated with an electrocoat material and the resulting electrocoat film is cured thermally to give the corrosion-inhibiting electrocoat;
2) the electrocoated metal parts of the body or cabin and/or of their replacement parts or add-on parts are integrated with the plastic parts of the body or cabin, said plastic parts having
   2.1) no priming on their surface,
   2.2) on their surface, priming consisting of an electrically conductive aqueous primer coating which is cured thermally at temperatures ≦100° C., or
   2.3) on their surface, a partially dried but not fully cured electrically conductive aqueous primer film;
3) the integrated metal-plastic body or cabin and its replacement parts and add-on parts are coated with an aqueous primer, where
   3.1) the integrated metal-plastic body or cabin and its replacement parts and add-on parts whose plastic parts have no primer (variant 2.1) are uniformly coated with an electrically conductive aqueous primer and the resulting aqueous primer film is cured at temperatures ≦100° C. to give a two-coat primer system comprising electrocoat and electrically conductive aqueous primer coat on the metal part's and a single-coat primer system comprising electrically conductive aqueous primer coat on the plastic parts;
   3.2) the integrated metal-plastic body or cabin and its replacement parts and add-on parts whose plastic parts have priming consisting of an aqueous primer coating (variant 2.2) are uniformly coated with a pale aqueous primer and the resulting pale aqueous primer film is cured at temperatures ≦100° C. to give a two-coat primer system comprising electrically conductive aqueous primer coat and pale aqueous primer coat on the plastic parts and a two-coat primer system comprising electrocoat and pale aqueous primer coat on the metal parts; or
   3.3) the integrated metal-plastic body or cabin and its replacement parts and add-on parts whose plastic parts have a partially dried electrically conductive aqueous primer film (variant 2.3) are uniformly coated, wet-on-wet in terms of the plastic parts, with a pale aqueous primer, after which the electrically conductive aqueous primer film and the pale aqueous primer film are jointly cured at temperatures ≦100° C. to give a two-coat primer system comprising electrically conductive aqueous primer coat and pale aqueous primer coat on the plastic parts and a two-coat primer system comprising electrocoat and pale aqueous primer coat on the metal parts;

4) an aqueous color and/or effect basecoat material is applied uniformly to the primer systems and the resulting aqueous basecoat film is partially dried without curing, after which
5) at least one two-component clearcoat material is applied wet-on-wet to the partially dried aqueous basecoat film to give at least one clearcoat film; and
6) the partially dried aqueous basecoat film and the at least one clearcoat film are jointly cured at temperatures ≦100° C., thermally or both thermally and with actinic radiation, to give the integrated multicoat color and/or effect paint system.

In the text below, the novel integrated process for painting automobile and commercial vehicle bodies or cabins and their replacement parts and add-on parts which comprise plastic parts is referred to for the sake of brevity as "process of the invention".

Additionally there has been found the novel integrated multicoat color and/or effect paint system for automobile and commercial vehicle bodies or cabins and their replacement parts and add-on parts which comprise plastic parts, comprising the following coats lying atop one another in the stated sequence:

1) on the metal parts, a cathodically or anodically, especially cathodically, deposited and thermally cured electrocoat and also an electrically conductive primer coat and/or a pale primer coat as the primer system, and
2) on the plastic parts, an electrically conductive primer coat or an electrically conductive primer coat and a pale primer coat as the primer system, with the proviso that the integrated automobile and commercial vehicle bodies or cabins and their replacement parts and add-on parts are uniformly covered over their surface by at least one primer coat; and
3) on the primer system of the metal parts and of the plastic parts, a color and/or effect basecoat, and
4) on the basecoat, at least one clearcoat.

In the text below, the novel integrated multicoat color and/or effect paint system for automobile and commercial vehicle bodies or cabins and their replacement parts and add-on parts which comprise plastic parts is referred to for the sake of brevity as "multicoat paint system of the invention".

In light of the prior art it was surprising and unforeseeable for the skilled worker that the complex problem on which the present invention was based could be solved by means of the process of the invention and the paint system of the invention. A particular surprise was that the use of an electrically conductive aqueous primer coat on both the plastic parts and the metal parts made a very substantial contribution to the solution. Even more surprising was that the problem could be solved substantially with the aid of aqueous coating materials, thereby making both the process of the invention and the paint system of the invention particularly environment-friendly. Furthermore, it could not have been foreseen that the process of the invention and the paint system of the invention would be superior in terms of their energy balance to conventional processes and paint systems.

The process of the invention is employed with automobile bodies, which nowadays consist of metal parts and plastic parts. It is also employed with commercial vehicle cabins, especially those of trucks and omnibuses, which nowadays likewise consist of these components. Furthermore, the process of the invention is employed in connection with the replacement parts and add-on parts of the bodies and cabins.

The process of the invention starts in step (1) from the electrocoating of parts of the body or cabin or their replacement parts and add-on parts which are made of metal. Suitable metals are the customary and known bodywork steels whose surface may have been galvanized and/or phosphated.

For the purpose of electrocoating, all customary anodic or cathodic electrocoating baths are suitable.

These electrocoating baths are aqueous coating materials having a solids content of in particular from 5 to 30% by weight.

The solids of the electrodeposition baths are composed of (A) customary and known binders which carry functional groups (a1), which are ionic or can be converted into ionic groups, and also functional groups (a2), which are capable of chemical crosslinking, the binders being externally crosslinking and/or self-crosslinking, but especially externally crosslinking:
(B) if desired, crosslinking agents which carry complementary functional groups (b1) which are able to undergo chemical crosslinking reactions with the functional groups (a2), and are employed mandatorily when the binders (A) are externally crosslinking; and
(C) customary and known coatings additives.

Where the crosslinking agents (B) and/or their functional groups (b1) have already been incorporated into the binders (A), the term self-crosslinking is used.

Suitable complementary functional groups ((a2) of the binders (A) include preferably thiol, amino, hydroxyl, carbamate, allophanate, carboxyl and/or (meth)acrylate groups, but especially hydroxyl groups, and suitable complementary functional groups (b1) include preferably anhydride, carboxyl, epoxy, blocked isocyanate, urethane, methylol, methylol ether, siloxane, amino, hydroxyl and/or beta-hydroxyalkylamide groups, but especially blocked isocyanate groups.

Examples of suitable functional groups (a1) which are ionic or can be converted into ionic groups of the binders (A) are (a11) functional groups which can be converted into cations by neutralizing agents and/or quaternizing agents, and/or cationic groups or
(a12) functional groups which can be converted into anions by neutralizing agents, and/or anionic groups.

The binders (A) containing functional groups (a11) are used in cathodically depositable electrocoat materials, whereas the binders (A) containing functional groups (a12) are employed in anodic electrocoat materials.

Examples of suitable functional groups (a11) for use in accordance with the invention which can be converted into cations by neutralizing agents and/or quaternizing agents are primary, secondary or tertiary amino groups, secondary sulfide groups or tertiary phosphine groups, especially tertiary amino groups or secondary sulfide groups.

Examples of suitable cationic groups (a11) for use in accordance with the invention are primary, secondary, tertiary or quaternary ammonium groups, tertiary sulfonium groups or quaternary phosphonium groups, preferably quaternary ammonium groups or quaternary ammonium groups, tertiary sulfonium groups, but especially quaternary ammonium groups.

Examples of suitable functional groups (a12) for use in accordance with the invention which can be converted into anions by neutralizing agents are carboxylic acid, sulfonic acid or phosphonic acid groups, especially carboxylic acid groups.

Examples of suitable anionic groups (a12) for use in accordance with the invention are carboxylate, sulfonate or phosphonate groups, especially carboxylate groups.

The selection of the groups (a11) or (a12) is to be made in such a way that disruptive reactions with the functional groups (a2) that can react with the crosslinking agents (B) are not possible. The skilled worker is therefore able to make the selection in a simple manner on the basis of his or her art knowledge.

Examples of suitable neutralizing agents for functional groups (a11) which can be transformed into cations are inorganic and organic acids such as sulfuric acid, hydrochloric acid, phosphoric acid, formic acid, acetic acid, lactic acid, dimethylolpropionic acid or citric acid, especially formic acid, acetic acid or lactic acid.

Examples of suitable neutralizing agents for functional groups (a12) which can be transformed into anions are ammonia, ammonium salts, such as ammonium carbonate or ammonium hydrogencarbonate, for example, and also amines, such as, for example, trimethylamine, triethylamine, tributylamine, dimethylaniline, diethylaniline, triphenylamine, dimethylethanolamine, diethylethanolamine, methyldiethanolamine, triethanolamine, and the like.

In general, the amount of neutralizing agent is chosen so that from 1 to 100 equivalents, preferably from 50 to 90 equivalents, of the functional groups (a11) or (a12) of the binder (b1) are neutralized.

Examples of suitable binders (A) for anodic electrocoat materials are known from the patent DE-A-28 24 418. These are preferably polyesters, epoxy resin esters, poly(meth) acrylates, maleate oils or polybutadiene oils having a weight-average molecular weight of from 300 to 10 000 daltons and an acid number of from 35 to 300 mg KOH/g.

Examples of suitable cathodic electrocoat materials are known from the patents EP-A-0 082 291, EP-A-0 234 395, EP-A-0 227 975, EP-A-0 178 531, EP-A-333 327, EP-A-0 310 971, EP-A-0 456 270, U.S. Pat. No. 3,922,253, EP-A-0 261 385, EP-A-0 245 786, DE-A-33 24 211, EP-A-0 414 199 or EP-A-476 514. These are preferably resins (A) which contain primary, secondary, tertiary or quaternary amino or ammonium groups and/or tertiary sulfonium groups and have amine numbers of preferably between 20 and 250 mg KOH/g and a weight-average molecular weight of preferably from 300 to 10 000 daltons. In particular, amino(meth) acrylate resins, amonoepoxide resins, amino epoxy resins having terminal double bonds, amino epoxy resins containing primary and/or secondary hydroxyl groups, amino polyurethane resins, amino-containing polybutadiene resins or modified epoxy resin-carbon dioxide-amine reaction products are [lacuna].

In accordance with the invention, cathodic electrocoat materials and the corresponding electrocoating baths are used with preference.

The electrocoating baths preferably comprise crosslinking agents (B).

Examples of suitable crosslinking agents (B) are blocked organic polyisocyanates, especially blocked polyisocyanates known as paint polyisocyanates, containing aliphatically, cycloaliphatically, araliphatically and/or aromatically attached blocked isocyanate groups.

For their preparation it is preferred to use poiyisocyanates containing from 2 to 5 isocyanate groups per molecule and having viscosities of from 100 to 10 000, preferably from 100 to 5 000, and in particular from 100 to 2 000, mPas (at 23° C.). Moreover, the polyisocyanates may have been hydrophilically or hydrophobically modified in a customary and known way. Examples of suitable polyisocyanates are described, for example, in "Methoden der organischen Chemie", Houben-Weyl, Volume 14/2, 4th Edition, Georg Thieme Verlag, Stuttgart 1963, page 61 to 70, and by W. Siefken, Liebigs Annalen der Chemie, Volume 562, pages 75 to 136.

Further examples of suitable polyisocyanates are isophorone diisocyanate (=5-isocyanato-1-isocyanatomethyl-1,3,3-trimethylcyclohexane), 5-isocyanato-1-(2-isocyanatoeth-1-yl)-1,3,3-trimethylcyclohexane, 5-isocyanato-1-(3-isocyanatoprop-1-yl)-1,3,3-trimethylcyclohexane, 5-isocyanato-(4-isocyanatobut-1-yl)-1,3,3-trimethylcyclohexane, 1-isocyanato-2-(3-isocyanatoprop-1-yl)cyclohexane, 1-isocyanato-2-(3-isocyanatoeth-1-yl) cyclohexane, 1-isocyanato-2-(4-isocyanatobut-1-yl) cyclohexane, 1,2-diisocyanatocyclobutane, 1,3-diisocyanatocyclobutane, 1,2-diisocyanatocyclopentane, 1,3-diisocyanatocyclopentane, 1,2-diisocyanatocyclohexane, 1,3-diisocyanatocyclohexane, 1,4-diisocyanatocyclohexane, dicyclohexylmethane 2,4'-diisocyanate, dicyclohexylmethane 4,4'-diisocyanate, liquid dicyclohexylmethane 4,4'-diisocyanate with a trans/trans content of up to 30% by weight, preferably 25% by weight and in particular 20% by weight, obtainable by phosgenating isomer mixtures of bis(4-aminocyclohexyl)methane or by fractionally crystallizing commercially customary bis(4-isocyanatocyclohexyl)methane in accordance with the patents DE-A-44 14 032, GB-A-1220717, DE-A-16 18 795 or DE-A-17 93 785; trimethylene diisocyanate, tetramethylene diisocyanate, pentamethylene diisocyanate, hexamethylene diisocyanate, ethylethylene diisocyanate, trimethylhexane diisocyanate, heptamethylene diisocyanate or diisocyanates derived from dimeric fatty acids, as marketed under the commercial designation DDI 1410 by the company Henkel and described in the patents WO 97/49745 and WO 97/49747, especially 2-heptyl-3,4-bis(9-isocyanatononyl)-1-pentylcyclohexane, 1,2-, 1,4- or 1,3-bis (isocyanatomethyl)cyclohexane, 1,2-, 1,4- or 1,3-bis(2-isocyanatoeth-1-yl)cyclohexane, 1,3-bis(3-isocyanatoprop-1-yl)cyclohexane or 1,2-, 1,4- or 1,3-bis(4-isocyanatobut-1-yl)cyclohexane, m-tetramethylxylylene diisocyanate (=1,3-bis(2-isocyanatoprop-2-yl)benzene or tolylene diisocyanate.

Examples of suitable polyisocyanate adducts are isocyanato-functional polyurethane prepolymers which are preparable by reacting polyols with an excess of polyisocyanates and are preferably of low viscosity. It is also possible to use polyisocyanates containing isocyanurate, biuret, allophanate, iminooxadiazinedione, urethane, urea carbodiimide and/or uretdione groups. Polyisocyanates containing urethane groups, for example, are obtained by reacting some of the isocyanate groups with polyols, such as trimethylolpropane and glycerol, for example.

Very particular preference is given to the use of mixtures of polyisocyanate adducts containing uretdione and/or isocyanurate and/or allophanate groups and based on hexamethylene diisocyanate, as are formed by catalytic oligomerization of hexamethylene diisocyanate using appropriate catalysts. Moreover, the polyisocyanate constituent may comprise any desired mixtures of the free polyisocyanates exemplified.

Examples of suitable blocking agents for preparing the blocked polyisocyanates (B) are the blocking agents known from the U.S. Pat. No. 4,444,954 such as i) phenols such as phenol, cresol, xylenol, nitrophenol, chlorophenol, ethylphenol, t-butylphenol, hydroxybenzoic acid, esters of this acid, or 2,5-di-tert-butyl-4-hydroxytoluene;

ii) lactams, such as ϵ-caprolactam, δ-valerolactam, γ-butyrolactam or β-propiolactam;

iii) active methylenic compounds, such as diethyl malonate, dimethyl malonate, ethyl or methyl acetoacetate, or acetylacetone;

iv) alcohols such as methanol, ethanol, n-propanol, isopropanol, n-butanol, isobutanol, t-butanol, n-amyl alcohol, t-amyl alcohol, lauryl alcohol, ethylene glycol monomethyl ether, ethylene glycol monoethyl ether, ethylene glycol monobutyl ether, diethylene glycol monomethyl ether, diethylene glycol monoethyl ether, propylene glycol monomethyl ether, methoxymethanol, glycolic acid, glycolic esters, lactic acid, lactic esters, methylolurea, methylolmelamine, diacetone alcohol, ethylenechlorohydrin, ethylenebromohydrin, 1,3-dichloro-2-propanol, 1,4-cyclohexyldimethanol or acetocyanohydrin;

v) mercaptans such as butyl mercaptan, hexyl mercaptan, t-butyl mercaptan, t-dodecyl mercaptan, 2-mercaptobenzothiazole, thiophenol, methylthiophenol or ethylthiophenol;

vi) acid amides such as acetoanilide, acetoanisidinamide, acrylamide, methacrylamide, acetamide, stearamide or benzamide;

vii) imides such as succinimide, phthalimide or maleimide;

viii) amines such as diphenylamine, phenylnaphthylamine, xylidine, N-phenylxylidine, carbazole, aniline, naphthylamine, butylamine, dibutylamine or butylphenylamine;

ix) imidazoles such as imidazole or 2-ethylimidazole;

x) ureas such as urea, thiourea, ethyleneurea, ethylenethiourea or 1,3-diphenylurea;

xi) carbamates such as phenyl N-phenylcarbamate or 2-oxazolidone;

xii) imines such as ethyleneimine;

xiii) oximes such as acetone oxime, formaldoxime, acetaldoxime, acetoxime, methyl ethyl ketoxime, diisobutyl ketoxime, diacetyl monoxime, benzophenone oxime or chlorohexanone oximes;

xiv) salts of sulfurous acid such as sodium bisulfite or potassium bisulfite;

xv) hydroxamic esters such as benzyl methacrylohydroxamate (BMH) or allyl methacrylohydroxamate; or xvi) substituted pyrazoles, ketoximes, imidazoles or triazoles; and also mixtures of these blocking agents, especially dimethylpyrazole and triazoles, malonic esters and acetoacetic esters, dimethylpyrazole and succinimide, or butyl diglycol and trimethylolpropane.

Further examples of suitable crosslinking agents (B) are all known aliphatic and/or cycloaliphatic and/or aromatic polyepoxides, based for example on bisphenol A or bisphenol F. Examples of suitable polyepoxides also include the polyepoxides obtainable commercially under the designations Epikote® from Shell, Denacol® from Nagase Chemicals Ltd., Japan, such as, for example, Denacol EX-411 (pentaerythritol polyglycidyl ether), Denacol EX-321 (trimethylolpropane polyglycidyl ether), Denacol EX-512 (polyglycerol polyglycidyl ether), and Denacol EX-521 (polyglycerol polyglycidyl ether).

As crosslinking agents (B) it is also possible to use tris(alkoxycarbonylamino)triazines (TACT) of the general formula

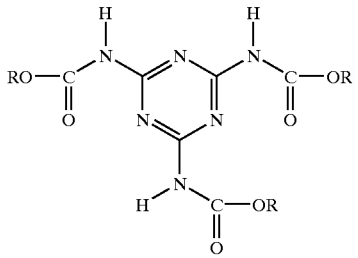

Examples of suitable tris(alkoxycarbonylamino)triazines (B) are described in the patents U.S. Pat. No. 4,939,213, US-A-5,084,541 or EP-A-0 624 577. Use is made in particular of the tris(methoxy-, tris(butoxy- and/or tris(2-ethylhexoxycarbonylamino)triazines.

The methyl butyl mixed esters, the butyl 2-ethylhexyl mixed esters, and the butyl esters are of advantage. They have the advantage over the straight methyl ester of better solubility in polymer melts, and also have less of a tendency to crystallize out.

Further examples of suitable crosslinking agents (B) are amino resins, examples being melamine resins, guanamine resins, benzoguanamine resins or urea resins. Also suitable ar the customary and known amino resins some of whose methylol and/or methoxymethyl groups have been defunctionalized by means of carbamate or allophanate groups. Crosslinking agents of this kind are described in the patents U.S. Pat. No. 4,710,542 and EP-B-0 245 700 and also in the article by B. Singh and coworkers, "Carbamylmethylated Melamines, Novel Cross-linkers for the Coatings Industry" in Advanced Organic Coatings Science and Technology Series, 1991, Volume 13, pages 193 to 207.

Further examples of suitable crosslinking agents (B) are beta-hydroxyalkylamides such as N,N,N',N'-tetrakis(2-hydroxyethyl)adipamide or N,N,N',N'-tetrakis(2-hydroxypropyl)adipamide.

Further examples, of suitable crosslinking agents (B) are compounds containing on average at least two groups capable of transesterification, examples being reaction products of malonic diesters and polyisocyanates or of esters and partial esters of polyhydric alcohols of malonic acid with monoisocyanates, as described in the European patent EP-A-0 596 460;

The amount of the crosslinking agents (B) in the electrocoat material may vary widely and is guided in particular, firstly, by the functionality of the crosslinking agents (B) and, secondly, by the number of crosslinking functional groups (a2) which are present in the binder (A), and also by the target crosslinking density. The skilled worker is therefore able to determine the amount of the crosslinking agents (B) on the basis of his or her general knowledge in the art, possibly with the aid of simple rangefinding experiments. Advantageously, the crosslinking agent (B) is present in the electrocoat material in an amount of from 5 to 60%, with particular preference from 10 to 50%, and in particular from 15 to 45% by weight, based in each case on the solids content of the coating material of the invention. It is further advisable here to choose the amounts of crosslinking agent (B) and binder (A) such that in the electrocoat material the ratio of functional groups (b1) in the crosslinking agent (B) to functional groups (a2) in the binder (A) is between 2:1 to 1:2, preferably from 1.5:1 to 1:1.5, with particular preference from 1.2:1 to 1:1.2, and in particular from 1.1:1 to 1:1.1.

The electrocoat material may comprise customary coatings additives (C) in effective amounts. Examples of suitable additives (C) are

- organic and/or inorganic pigments, anticorrosion pigments and/or fillers such as calcium sulfate, barium sulfate, silicates such as talc or kaolin, silicas, oxides such as aluminum hydroxide or magnesium hydroxide, nanoparticles, organic fillers such as textile fibers, cellulose fibers, polyethylene fibers or wood flour, titanium dioxide, carbon black, iron oxide, zinc phosphate or lead silicate; these additives may also be incorporated into the electrocoat materials of the invention by way of pigment pastes;
- free-radical scavengers;
- organic corrosion inhibitors;
- crosslinking catalysts such as organic and inorganic salts and complexes of tin, lead, antimony, bismuth, iron or manganese, preferably organic salts and complexes of bismuth and of tin, especially bismuth lactate, ethylhexanoate or dimethylolpropionate, dibutyltin oxide or dibutyltin dilaurate;
- slip additives;
- polymerization inhibitors;
- defoamers;
- emulsifiers, especially nonionic emulsifiers such as alkoxylated alkanols and polyols, phenols and alkylphenols or anionic emulsifiers such as alkali metal salts or ammonium salts of alkanecarboxylic acids, alkanesulfonic acids, and sulfo acids of alkoxylated alkanols and polyols, phenols and alkylphenols;
- wetting agents such as siloxanes, fluorine compounds, carboxylic monoesters, phosphoric esters, polyacrylic acids and their copolymers, or polyurethanes;
- adhesion promoters;
- leveling agents;
- film-forming auxiliaries such as cellulose derivatives;
- flame retardants;
- organic solvents;
- low molecular mass, oligomeric and high molecular mass reactive diluents which are able to participate in the thermal crosslinking, especially polyols such as tricyclodecanedimethanol, dendrimeric polyols, hyperbranched polyesters, polyols based on metathesis oligomers or on branched alkanes having more than eight carbon atoms in the molecule;
- anticrater agents;

Further examples of suitable coatings additives are described in the textbook "Lackadditive" [Additives for coatings] by Johan Bieleman, Wiley-VCH, Weinheim, N.Y., 1998.

In accordance with the invention, lead-free cathodic electrocoat materials afford particular advantages and are therefore used with preference.

Viewed in terms of its method, the electrocoating has no special features but is instead conducted in the usual manner by connecting the metals to be coated in the electrocoating bath as cathode or anode, especially cathode, and then depositing the electrocoat material on the metal surface. After the metal parts have been removed from the electrocoating bath, and after a certain rest period, the electrocoat film is cured thermally in a customary and known way to give the electrocoat.

Thereafter, the electrocoated metal parts are integrated—preferably joined with a precision fit—with the plastic parts, in step (2) of the process of the invention. In this step, the metal parts may be positioned precisely on a skid and then the plastic parts attached. Preferably, however, the plastic parts are positioned precisely on the skid and the metal parts are attached. It is then possible to give a uniform paint finish to the entire structure; that is, the integrated body or cabin, in one operation.

As far as the plastic parts are concerned, three variants arise in accordance with the invention.

First, the plastic parts have no priming (variant 2.1).

Secondly, the plastic parts have priming on their surface, comprising an electrically conductive aqueous primer coat which is cured thermally at temperatures ≦100° C. (variant 2.2).

Thirdly, the plastic parts have on their surface a partially dried but not fully cured electrically conductive aqueous primer film (variant 2.3).

Consequently, there are three variants of the invention for step (3) of the process of the invention:

Variant 3.1):

The integrated metal-plastic body or cabin and its replacement parts and add-on parts whose plastic parts have no priming (variant 2.1) is coated uniformly on its surface with an electrically conductive aqueous primer, and the resulting aqueous primer film is cured at temperatures ≦100° C. to give a two-coat primer system comprising electrocoat and electrically conductive aqueous primer coat on the metal parts and a single-coat primer system comprising electrically conductive aqueous primer coating on the plastic parts.

In the case of this variants it is further possible to (3.1.1) apply a pale aqueous primer uniformly to the cured electrically conductive aqueous primer coat and to cure the resulting pale aqueous primer coat thermally at temperatures ≦100° C. or (3.1.2) partially dry the electrically conductive aqueous primer film following its application, without full curing, to apply a pale aqueous primer wet-on-wet to the partially dried electrically conductive aqueous primer film, and then to cure the electrically conductive aqueous primer film and the resulting pale aqueous primer film jointly at temperatures ≦100° C.

Both variants (3.1.1) and (3.1.2) result in a three-coat primer system comprising electrocoat, electrically conductive aqueous primer coat and pale aqueous primer coat on the metal parts and a two-coat primer system comprising electrically conductive aqueous primer coat and pale aqueous primer coat on the plastic parts.

Variant 3.2):

The integrated metal-plastic body or cabin and its replacement parts and add-on parts whose plastic parts have priming consisting of an aqueous primer coat (variant 2.2) is coated uniformly on its surface with a pale aqueous primer, and the resulting pale aqueous primer film is cured at temperatures ≦100° C. to give a two-coat primer system comprising electrically conductive aqueous primer coat and pale aqueous primer coat on the plastic parts and a two-coat primer system comprising electrocoat and pale aqueous primer coat on the metal parts.

Variant 3.3):

The integrated metal-plastic body or cabin and its replacement parts and add-on parts whose plastic parts have a partially dried electrically conductive aqueous primer film (variant 2.3) is coated uniformly on its surface, wet-on-wet in terms of the plastic parts, with a pale aqueous primer, after which the electrically conductive aqueous primer film and the pale aqueous primer film are cured jointly at temperatures ≦100° C. to give a two-coat primer system comprising electrically conductive aqueous primer coat and pale aqueous primer coat on the plastic parts and a two-coat primer system comprising electrocoat and pale aqueous primer coat on the metal parts.

The choice of which variant of the process of the invention is employed in a specific case is guided by the particular problem and by the particular existing equipment.

Suitable in accordance with the invention for all variants of the process of the invention are all electrically conductive aqueous primers such as are commonly used for the coating of plastics such as ABS, AMMA, ASA, CA, CAB, EP, UF, CF, MF, MPF, PF, PAN, PA, PE, HDPE, LDPE, LLDPE, UHMWPE, PET, PMMA, PP, PS, SB, PUR, PVC, RF, SAN, PBT, PPE, POM, PUR-RIM, SMC, BMC, PP-EPDM, and UP (abbreviations in accordance with DIN 7728T1) and also polymer blends thereof and fiber reinforced plastics on this basis and can be cured at temperatures $\leqq 100°$ C. Where appropriate, for purposes of better adhesion of the aqueous primer, the plastic parts are pretreated in power wash installations or by flaming or by plasma treatment.

Suitable electrically conductive aqueous primers constitute what are known as two-component systems. Component I of the electrically conductive aqueous primers comprise customary and known aqueous polyurethane dispersions, preferably based on polyester-polyurethanes.

Suitable polyester-polyurethanes normally contain the above-described (potentially) cationic functional groups (a11) or the (potentially) anionic functional groups (a12). Instead of these functional groups or in addition to them they may contain nonionic functional groups (a13) based on polyalkylene ethers. They are obtained by reacting

- polyesterpolyols and
- compounds by means of which stabilizing (potentially) ionic and/or nonionic functional groups are introduced, and also, if desired,
- polyamines, and
- amino alcohols with polyisocyanates, especially the diisocyanates described above.

The polyesterpolyols are obtainable by reacting

- unsulfonated or sulfonated saturated and/or saturated polycarboxylic acids or their esterifiable derivatives, alone or together with monocarboxylic acids, and
- saturated and/or unsaturated polyols, alone or together with monools.

Examples of suitable polycarboxylic acids are aromatic, aliphatic and cycloaliphatic polycarboxylic acids. Preference is given to using aromatic and/or aliphatic, especially aromatic, polycarboxylic acids.

Examples of suitable aromatic polycarboxylic acids are phthalic acid, isophthalic acid, terephthalic acid, phthalic, isophthalic or terephthalic monosulfonate, or halophthalic acids, such as tetrachloro- and/or tetrabromophthalic acid, of which isophthalic acid is advantageous and is therefore used with preference.

Examples of suitable acyclic aliphatic or unsaturated polycarboxylic acids are oxalic acid, malonic acid, succinic acid, glutaric acid, adipic acid, pimelic acid, suberic acid, azelaic acid, sebacic acid, undecanedicarboxylic acid, dodecanedicarboxylic acid or dimer fatty acids or maleic acid, fumaric acid or itaconic acid, of which adipic acid, glutaric acid, azelaic acid, sebacic acid, dimer fatty acids and maleic acid are advantageous and therefore used with preference.

Examples of suitable cycloaliphatic and cyclic unsaturated polycarboxylic acids are 1,2-cyclobutanedicarboxylic acid, 1,3-cyclobutanedicarboxylic acid, 1,2-cyclopentanedicarboxylic acid, 1,3-cyclopentanedicarboxylic acid, hexahydrophthalic acid, 1,3-cyclohexanedicarboxylic acid, 1,4-cyclohexanedicarboxylic acid, 4-methylhexahydrophthalic acid, tricyclodecanedicarboxylic acid, tetrahydrophthalic acid or 4-methyltetrahydrophthalic acid. These dicarboxylic acids may be used both in their cis and in their trans form and also as a mixture of both forms.

Also suitable are the esterifiable derivatives of the above-mentioned polycarboxylic acids, such as, for example, their monoesters or polyesters with aliphatic alcohols having from 1 to 4 carbon atoms or hydroxy alcohols having from 1 to 4 carbon atoms. Moreover, it is also possible to use the anhydrides of the above-mentioned polycarboxylic acids, where they exist.

If desired it is possible, together with the polycarboxylic acids, to use monocarboxylic acids too, such as benzoic acid, tert-butylbenzoic acid, lauric acid, isononanoic acid, fatty acids of naturally occurring oils, acrylic acid, methacrylic acid, ethacrylic acid or crotonic acid, for example. As monocarboxylic acid it is preferred to use isononanoic acid.

Examples of suitable polyols are diols and triols, especially diols. Normally, triols are used in minor amounts alongside the diols in order to introduce branches into the polyesterpolyols.

Suitable diols are ethylene glycol, 1,2- or 1,3-propanediol, 1,2-, 1,3- or 1,4-butanediol, 1,2-, 1,3-, 1,4- or 1,5-pentanediol, 1,2-, 1,3-, 1,4-, 1,5- or 1,6-hexanediol, neopentyl hydroxypivalate, neopentyl glycol, diethylene glycol, 1,2-, 1,3- or 1,4-cyclohexanediol, 1,2-, 1,3- or 1,4-cyclohexanedimethanol, trimethylpentanediol, ethylbutylpropanediol, or the positionally isomeric diethyloctanediols. These diols may also be used per se for the preparation of the polyurethanes (A) for inventive use.

Further examples of suitable diols are diols of the formula I or II:

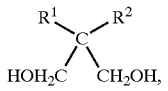

(I)

in which $R^1$ and $R^2$ each represent an identical or different radical and stand for an alkyl radical having from 1 to 18 carbon atoms, an aryl radical or a cycloaliphatic radical, with the proviso that $R^1$ and/or $R^2$ may not be methyl;

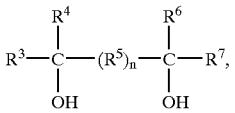

(II)

in which $R^3$, $R^4$, $R^6$ and $R^7$ each represent identical or different radicals and stand for an alkyl radical having from 1 to 6 carbon atoms, a cycloalkyl radical or an aryl radical and $R^5$ represents an alkyl radical having from 1 to 6 carbon atoms, an aryl radical or an unsaturated alkyl radical having from 1 to 6 carbon atoms, and n is either 0 or 1.

Suitable diols I of the general formula I are all propanediols of the formula ir which either $R^1$ or $R^2$ or $R^1$ and $R^2$ is not equal to methyl, such as 2-butyl-2-ethylpropane-1,3-diol, 2-butyl-2-methylpropane-1,3-diol, 2-phenyl-2-methylpropane-1,3-diol, 2-propyl-2-ethylpropane-1,3-diol, 2-di-tert-butylpropane-1,3-diol, 2-butyl-2-propylpropane-1,3-diol, 1-dihydroxymethylbicyclo[2.2.1]heptane, 2,2-diethylpropane-1,3-diol, 2,2-dipropylpropane-1,3-diol or 2-cyclohexyl-2-methylpropane-1,3-diol and others, for example.

As diols II of the general formula II it is possible, for example, to use 2,5-dimethylhexane-2,5-diol, 2,5-diethylhexane-2,5-diol, 2-ethyl-5-methylhexane-2,5-diol, 2,4-dimethylpentane-2,4-diol, 2,3-dimethylbutane-2,3-diol, 1,4-(2'-hydroxypropyl)benzene and 1,3-(2'-hydroxypropyl) benzene.

Of these diols, hexanediol and neopentyl glycol are particularly advantageous and are therefore used with particular preference.

The abovementioned diols may also be used per se for the preparation of the polyester-polyurethanes.

Examples of suitable triols are trimethylolethane, trimethylolpropane or glycerol, especially trimethylolpropane.

The abovementioned triols may also be used as well per se for the preparation of the polyester-polyurethanes (cf. the patent EP-A-0 339 433).

If desired, minor amounts of monools may be used as well. Examples of suitable monools are alcohols or phenols such as ethanol, propanol, n-butanol, sec-butanol, tert-butanol, amyl alcohols, hexanols, fatty alcohols, allyl alcohol or phenol.

The polesterpolyols may be prepared in the presence of small amounts of an appropriate solvent as entrainer. Entrainers used include, for example, aromatic hydrocarbons, such as particularly xylene and (cyclo)-aliphatic hydrocarbons, e.g., cyclohexane or methylcyclohexane.

Further examples of suitable polyols are polyesterdiols which are obtained by reacting a lactone with a diol. They are notable for the presence of terminal hydroxyl groups and repeating polyester units of the formula —(—CO—$(CHR^8)_m$—$CH_2$—O—)—. In this formula the index m is preferably from 4 to 6 and the substituent $R^8$=hydrogen, an alkyl, cycloalkyl or alkoxy radical. No one substituent contains more than 12 carbon atoms. The total number of carbon atoms in the substituent does not exceed 12 per lactone ring. Examples thereof are hydroxycaproic acid, hydroxybutyric acid, hydroxydecanoic acid and/or hydroxystearic acid.

For the preparation of the polyesterdiols preference is given to the unsubstituted caprolactone, in which m has the value 4 and all $R^8$ substituents are hydrogen. The reaction with lactone is stated by low molecular mass polyols such as ethylene glycol, 1,3-propanediol, 1,4-butanediol or dimethylolcyclohexane. It is, however, also possible to react other reaction components, such as ethylenediamine, alkyldiakanolamine or else urea, with caprolactone. Further suitable high molecular mass diols include polylactamidols, prepared by reacting, for example, ###ε-caprolactam with low molecular mass diols.

In addition to the above-described polyesterpolyols, use may be made of polyetherpolyols, especially those having a number-average molecular weight of from 400 to 5 000, in particular from 400 to 3 000. Highly suitable polyetherdiols are, for example, polyetherdiols of the general formula H—(O—$(CHR^9)_o$—)$_p$OH, in which the substituent $R^9$=hydrogen or is a lower, unsubstituted or substituted alkyl radical, the index o=2 to 6, preferably 3 to 4, and the index p=2 to 100, preferably 5 to 50. Cited as particularly suitable examples are linear or branched polyetherdiols such as poly(oxyethylene) glycols, poly(oxypropylene) glycols and poly(oxybutylene) glycols.

The polyetherdiols should on the one hand not introduce excessive amounts of ether groups, since otherwise the polyurethanes that are formed undergo incipient swelling in water. On the other hand, they may be used in amounts which ensures the nonionic stabilization of the polyurethanes. In that case they serve as chain-internal functional nonionic groups (a13).

The introduction of (potentially) cationic functional groups (a11) takes place by way of the incorporation of compounds which contain at least one, especially two, isocyanate-reactive groups and at least one group capable of forming cations in the molecule; the amount to be used may be calculated from the target amine number.

Particularly suitable isocyanate-reactive groups are hydroxyl groups and also primary and/or secondary amino groups, of which the hydroxyl groups are used with preference.

Examples of suitable compounds of this kind are 2,2-dimethylolethyl- or -propylamine that have been blocked with a ketone, the resulting ketoxime group being hydrolzyed again before the cationic group (b1) is formed, or N,N-dimethyl-, N,N-diethyl- or N-methyl-N-ethyl-2,2-dimethylolethyl- or -propylamine.

The Introduction of (potentially) anionic groups (a12) into the polyurethane molecules takes place by way of the incorporation of compounds which contain at least one isocyanate-reactive group and at least one group capable of forming anions in the molecule; the amount to be used may be calculated from the target acid number.

Examples of suitable compounds of this kind are those which contain two isocyanate-reactive groups in the molecule. Suitable isocyanate-reactive groups are, in particular, hydroxyl groups, and also primary and/or secondary amino groups. Accordingly, it is possible, for example, to use alkanoic acids having two substituents on the ###α carbon atom. The substituent may be a hydroxyl group, an alkyl group or, preferably, an alkylol group. These alkanoic acids have at least one, in general from 1 to 3, carboxyl groups in the molecule. They have from 2 to about 25, preferably from 3 to 10, carbon atoms. Examples of suitable alkanoic acids are dihydroxypropionic acid, dihydroxysuccimic acid and dihydroxybenzoic acid. One particularly preferred group of alkanoic acids are ###α, ###α-dimethylolalkanoic acids of the general formula $R^{10}$—$C(CH_2OH)_2COOH$, in which $R^{10}$ stands for a hydrogen atom or an alkyl group having up to about 20 carbon atoms. Examples of especially suitable alkanoic acids are 2,2-dimethylolacetic acid, 2,2-dimethylolpropionic acid, 2,2-dimethylolbutyric acid and 2,2-dimethylolpentanoic acid. The preferred dihydroxyalkanoic acid is 2,2-dimethylolpropionic acid. Examples of compounds containing amino groups are ###α, ###δ-diaminovaleric acid, 3,4-diaminobenzoic acid, 2,4-diaminotoluenesulfonic acid and 2,4-diaminodiphenyl ether sulfonic acid.

Nonionic stabilizing poly(oxyalkylene) groups (a13) may be introduced as lateral or terminal groups into the polyurethane molecules. For this purpose it is possible, for example, to use alkoxypoly(oxyalkylene) alcohols having the general formula $R^{11}$O—(—$CH_2$—$CH^{12}$—O—)$_r$H in which $R^{11}$ stands for an alkyl radical having from 1 to 6 carbon atoms, $R^{12}$ stands for a hydrogen atom or an alkyl radical having from 1 to 6 carbon atoms and the index r stands for a number between 20 and 75. (cf. the patents EP-A-0 354 261 or EP-A-0 424 705).

The use of polyols, polyamines and amino alcohols leads to the molecular weight increase of the polyurethanes.

Suitable polyols for the chain extension are polyols having up to 36 carbon atoms per molecule such as ethylene glycol, diethylene glycol, triethylene glycol, 1,2-propanediol, 1,3-propanediol, 1,4-butanediol, 1,2-butylene glycol, 1,6-hexanediol, trimethylolpropane, castor oil or hydrogenated castor oil, ditrimethylolpropane ether, pentaerythritol, 1,2-cyclohexanediol, 1,4-cyclohexanedimethanol, bisphenol A, bisphenol F, neopentyl glycol, neopentyl glycol hydroxypivalate, hydroxyethylated or hydroxypropylated bisphenol A, hydrogenated bisphenol A or mixtures thereof (cf. patents EP-A-0 339 433, EP-A-0 436 941, EP-A-0 517 707).

Examples of suitable polyamines have at least two primary and/or secondary amino groups. Polyamines are essentially alkylene polyamines having from 1 to 40 carbon atoms, preferably from about 2 to 15 carbon atoms. They may carry substituents which have no hydrogen atoms that are reactive with isocyanate groups. Examples are polyamines having a linear or branched aliphatic, cycloaliphatic or aromatic structure and containing at least two primary amino groups.

As diamines, mention may be made of hydrazine, ethylenediamine, propylenediamine, 1,4-butylenediamine, piperazine, 1,4-cyclohexyldimethylamine, 1,6-hexamethylenediamine, trimethylhexamethylenediamine, methanediamine, isophoronediamine, 4,4'-diaminodicyclohexylmethane and aminoethyleneothanolamine. Preferred diamines are hydrazine, alkyl- or cycloalkyldiamines such as propylenediamine and 1-amino-3-aminomethyl-3,5,5-trimethylcyclohexane.

It is also possible to use polyamines which contain more than two amino groups in the molecule. In these cases, however, it must be ensured—for example, by using monoamines as well—that crosslinked polyurethane resins are not obtained. Polyamines of this kind which can be used are diethylenetriamine, triethylenetetramine, dipropylenediamine and dibutylenetriamine. An example to be mentioned of a monoamine is ethylhexylamine (cf. the patent EP-A-0 089 497).

Examples of suitable amino alcohols are ethanolamine or diethanolamine.

The polyurethanes may contain terminal and/or lateral olefinically unsaturated groups. Groups of this kind may be introduced, for example, with the aid of compounds which contain at least one isocyanate-reactive group, especially hydroxyl group, and at least one vinyl group. Examples of suitable compounds of this kind are trimethylolpropane monoallyl ether or trimethylolpropane mono(meth)acrylate.

The polyurethanes may be grafted with ethylenically unsaturated compounds. Examples of suitable polyurethanes (A) for inventive use which are present in the form of graft copolymers are known from the patents EP-A-0 521 928, EP-A-0 522 420, EP-A-0 522 419 or EP-A-0 730 613.

In terms of its method the preparation of the polyurethanes has no special features but instead takes place in accordance with the customary and known methods of polyurethane chemistry.

To prepare the electrically conductive aqueous primer, the polyurethanes are neutralized with the neutralizing agents described above and dispersed in water to give a dispersion having a solids content preferably from 10 to 70%, more preferably from 20 to 60%, with particular preference from 25 to 50%, and in particular from 30 to 45%, by weight based in each case on the dispersion.

The further essential constituent component I of the electrically conductive aqueous primer for use in accordance with the invention is at least one electrically conductive pigment. Examples of suitable electrically conductive pigments are metal pigments, conductivity carbon blacks, doped pearlescent pigments or conductive barium sulfate. Particularly suitable electrically conductive pigments are the conductivity blacks For further details, refer to Römpp Lexikon Lacke und Druckfarben, Georg Thieme Verlag, Stuttgart, N.Y., 1998, "metal pigments", p. 381, and "conductive pigments", p. 354.

The amount of electrically conductive pigments in the electrically conductive aqueous primer may vary very widely and is preferably from 0.01 to 10%, more preferably from 0.1 to 8%, with particular preference from 0.5 to 7%, with very particular preference from 0.5 to 6%, and in particular from 0.5 to 5% by weight, based in each case on the total amount of the electrically conductive aqueous primer.

The electrically conductive aqueous primer may further comprise the above-described customary coatings additives (C) in customary and known, effective amounts, and also water-miscible organic solvents and/or rheology control additives, such as those known from the patents WO 94/22968, EP-A-0 276 501, EP-A-0 249 201 or WO 97/12945; crosslinked polymeric microparticles, such as are disclosed, for example, in EP-A-0 008 127; inorganic phyllosilicates, preferably smectites, especially montmorillonites and hectorites, such as aluminum magnesium silicates, sodium magnesium phyllosilicates and sodium magnesium fluorolithium phyllosilicates of the montmorillonite type or inorganic phyllosilicates such as aluminum magnesium silicates, sodium magnesium phyllosilicates and sodium magnesium fluorolithium phyllosilicates of the montmorillonite type (for further details refer to the book by Johan Bielemann "Lackadditive", Wiley-VCH, Weinheim, N.Y., 1998, pages 17 to 30); silicas such as Aerosils; or synthetic polymers containing ionic and/or associative groups such as polyvinyl alcohol, poly(meth)acrylamide, poly(meth)acrylic acid, polyvinylpyrrolidone, styrene-maleic anhydride copolymers or ethylene-maleic anhydride copolymers and their derivatives, or hydrophobically modified polyacrylates; or polyurethane-based associative thickeners, such as are described in Römpp Lexikon Lacke und Druckfarben, Georg Thieme Verlag, Stuttgart, N.Y., 1998, "thickeners", pages 599 to 600, and in the textbook "Lackadditive" by Johan Bieleman, Wiley-VCH, Weinheim, N.Y., 1998, pages 51 to 59 and 65.

Component II of the electrically conductive aqueous primer for use in accordance with the invention comprises at least one polyisocyanate which is advantageously liquid per se. Furthermore, the component II may also include customary and known organic solvents which are inert toward polyisocyanates.

Until the use of the electrically conductive aqueous primer in the process of the invention, its components I and II are stored separately from one another.

The weight ratio of component I and component II may vary extremely widely and is guided on the one hand by the crosslinking density which the cured electrically conductive aqueous primer coat is to have and on the other hand by the number of isocyanate-reactive groups in component I and also the functionality and the concentration of the polyisocyanates in component II. The weight ratio I:II is advantageously 100:50, preferably 100:40, more preferably 100:30, with particular preference 100:20, with very particular preference 100:15, and in particular 100:10.

Following its application in a customary and known way, the aqueous primer is cured thermally in step (3) of the process of the invention at temperatures <100° C. so as to give the electrically conductive aqueous primer coat.

Examples of suitable pale aqueous primers for use in accordance with the invention are likewise two-component systems. Their component I comprises at least one hydroxyl-containing binder dispersed or dissolved in water and at least one pale pigment, and their component II comprises at least one polyisocyanate.

Suitable hydroxyl-containing binders include polyesters, polyacrylates, polyurethanes, acrylated polyesters and/or acrylated polyurethanes, especially polyurethanes. Examples of suitable polyurethanes are those described above.

Examples of suitable pale pigments are the pigments described above and below provided they are pale and opaque.

Suitable components II include the above-described components II.

The pale aqueous primers are employed advantageously when an approximate match is needed between the color of the preferably dark, electrically conductive aqueous primer coat and that of the aqueous basecoat, which in particular is pale.

In accordance with the invention, an aqueous color and/or effect basecoat material is applied to the primer system of the integrated body or cabin or its replacement parts and add-on parts that is the result of step (3) of the process.

Suitable aqueous basecoat materials comprise at least one hydroxyl-containing binder in dispersion or solution in water, and at least one color and/or effect pigment. They may further comprise the above-described customary coatings additives and also at least one of the above-described crosslinking agents in the known effective amounts.

Examples of suitable hydroxyl-containing binders are polyurethanes and/or acrylated polyurethanes.

The aqueous basecoat material may further comprise at least one hydroxyl-containing polyacrylate, a hydroxyl-containing polyester and/or a hydroxyl-containing acrylated polyester as additional binder(s).

Examples of suitable color and/or effect pigments may be prepared from organic or inorganic compounds. Owing to this large number of suitable pigments, therefore, the aqueous basecoat material for use in accordance with the invention ensures a universal scope for use and makes it possible to realize a large number of colors and optical effects.

The effect pigments which can be used include metal flake pigments such as commercial aluminum bronzes, aluminum bronzes chromated as per DE-A-36 36 183, commercial stainless steel bronzes, and nonmetallic effect pigments, such as pearlescent pigments and interference pigments, for example. For further details, refer to Römpp Lexikon Lacke und Druckfarben, Georg Thieme Verlag, 1998, pages 176, "effect pigments" and pages 380 and 381 "metal oxide-mica pigments" to "metal pigments".

Examples of suitable inorganic color pigments are titanium dioxide, iron oxides, Sicotrans yellow and carbon black. Examples of suitable organic color pigments are thioindigo pigments indanthrene blue, Cromophthal red, Irgazine orange and Heliogen green. For further details refer to Römpp Lexikon Lacke und Druckfarben, Georg Thieme Verlag, 1998, pages 180 and 181, "iron blue pigments" to "black iron oxide", pages 451 to 453 "pigments" to "pigment volume concentration", page 563 "thioindigo pigments" and page 567 "titanium dioxide pigments".

The fraction of the pigments in the aqueous basecoat material may vary extremely widely and is guided primarily by the opacity of the pigments, the desired color, and the desired optical effect. The pigments are preferably present in the aqueous basecoat material of the invention in an amount of from 0.5 to 50%, more preferably from 0.5 to 45%, with particular preference from 0.5 to 40%, with very particular preference from 0.5 to 35%, and in particular from 0.5 to 30% by weight, based in each case on the overall weight of the aqueous basecoat material. The pigment/binder ratio, i.e., the ratio of the pigments to the polyurethanes and other binders (where present) may also vary extremely widely. This ratio is preferably from 6.0:1.0 to 1.0:50, more preferably from 5:1.0 to 1.0:50, with particular preference from 4.5:1.0 to 1.0:40, with very particular preference from 4:1.0 to 1.0:30, and in particular from 3.5:1.0 to 1.0:25.

These pigments may also be incorporated into the aqueous basecoat materials of the invention by way of pigment pastes, with the polyurethanes, inter alia, being candidates for use as grinding resins.

Suitable starting compounds for preparing the polyurethanes are those described above in connection with the preparation of the aqueous primers.

Examples of highly suitable aqueous basecoat materials and of the corresponding coatings are known from the patents EP-A-0 089 497, EP-A-0 256 540, EP-A-0 260 447, EP-A-0 297 576, WO 96/12747, EP-A-0 523 610, EP-A-0 228 003, EP-A-0 397 806, EP-A-0 574 417, EP-A-0 531 510, EP-A-0 581 211, EP-A-0 708 788, EP-A-0 593 454, DE-A-43 28 092, EP-A-0 299 148, EP-A-0 394 737, EP-A-0 590 484, EP-A-0 234 362, EP-A-0 234 361, EP-A-0 543 817, wO 95/14721, EP-A-0 521 928, EP-A-0 522 420, EP-A-0 522 419, EP-A-0 649 865, EP-A-0 536 712, EP-A-0 596 460, EP-A-0 596 461, EP-A-0 584 818, EP-A-0 669 356, EP-A-0 634 431, EP-A-0 678 536, EP-A-0 354 261, EP-A-0 424 705, WO 97/49745, WO 97/49747, EP-A-0 401 565, EP-B-0 730 613 or WO 95/14721.

Following its application in a customary and known way the aqueous base coat material is not cured thermally butt instead may be partially dried.

In accordance with the process of the invention, in step (5) of the process, at least one, preferably one, two-component clearcoat material is applied wet-on-wet to the partially dried aqueous basecoat film, to give the clearcoat film.

As is known, the two-component clearcoat materials comprise a component I having at least one hydroxyl-containing binder and a component II having at least one polyisocyanate. Up until the time of their joint use, the components I and II are stored separately from one another.

Examples of suitable polyisocyanates are those described above.

Examples of suitable hydroxyl-containing binders are oligomeric or polymeric, random, alternating and/or block linear and/or branched and/or comb addition (co)polymers of ethylenically unsaturated monomers, or polyaddition resins and/or polycondensation resins. For further details of these terms, refer to Römpp Lexikon Lacke und Druckfarben, Georg Thieme Verlag, Stuttgart, N.Y., 1998, page 457, "polyaddition" and "polyaddition resins (polyadducts)", and also pages 463 and 464, "polycondensates", "polycondensation", and "polycondensation resins".

Examples of highly suitable addition (co)polymers are poly(meth)acrylates and partially saponified polyvinyl esters.

Examples of highly suitable polyaddition resins and/or polycondensation resins are polyesters, alkyds, polyurethanes, polylactones, polycarbonates, polyethers, epoxy resin-amine adducts, polyureas, polyamides or polyimides.

The hydroxyl-containing binders or resins for use in accordance with the invention are oligomers and polymers. In the context of the present invention, oligomers are resins containing in their molecule at least 2 to 15 repeating monomer units. In the context of the present invention, polymers are resins whose molecule contains at least 10 repeating monomer units. For further details of these terms, refer to Römpp Lexikon Lacke und Druckfarben, Georg Thieme Verlag, Stuttgart, N.Y., 1998, "oligomers" page 425.

The hydroxyl-containing resins for use in accordance with the invention contain primary and/or secondary hydroxyl groups. It is a very substantial advantage of the process of the invention and of the resins of the invention that both kinds of hydroxyl groups can be used. This makes it possible to tailor the reactivity of the resins of the invention by way of steric effects.

The OH number of hydroxyl-containing resins for use in accordance with the invention may vary very widely and is preferably from 10 to 500, more preferably from 20 to 400, and in particular from 30 to 350, mg KOH/g.

The resin may further contain at least one functional group which on exposure to actinic radiation reacts with a group of its kind or with another function al group. These functional groups may already be present in the hydroxyl-containing resins for use in accordance with the invention or may be introduced into the resins subsequently by means of polymer-analogous reactions.

Examples of suitable functional groups of this kind are allyl, vinyl acrylate or methacrylate groups, especially acrylate groups. The actinic radiation may comprise electromagnetic radiation such as X-rays, UV radiation, visible light or near IR (NIR) light or corpuscular radiation such as electron beams.

Of the above-described hydroxyl-containing binders, the poly(meth)acrylates, the polyesters, and the polyurethanes are used with preference. Particular advantages result from the joint use of the poly(meth)acrylates and the polyesters.

Besides the binders and the polyisocyanates, the two-component clearcoat materials for use in accordance with the invention may also comprise the above-described customary coating additives in the known effective amounts. It is self-evident that in this case the only additives employed are those which do not detract from the transparency of the clearcoat. Other examples of suitable additives for clearcoat materials are

- crosslinking catalysts such as dibutyltin dilaurate, lithium decanoate or zinc octoate;
- transparent fillers based on silica, alumina or zirconium oxide; for further details refer to Römpp Lexikon Lacke und Druckfarben, Georg Thieme Verlag, Stuttgart, 1998, pages 250 to 252;
- sag control agents such as ureas, modified ureas and/or silicas, such as described, for example, in the references EP-A-192 304, DE-A-23 59 923, DE-A-18 05 693, WO 94/22968, DE-C-27 51 761, WO 97/12945 or "farbe+lack", 11/1992, pages 829 ff.; and/or
- flatting agents such as magnesium stearate.

Following application, in step (6) of the process of the invention the aqueous basecoat film and clearcoat film are cured jointly at temperatures ≦100° C., thermally or both thermally and with actinic radiation, with the two-component clearcoat material in particular being cured thermally or both thermally and with actinic radiation (dual cure). This results in the basecoat and the clearcoat.

In a further process step, (7), the clearcoat may be overcoated with a highly scratch-resistant clearcoat. Examples of suitable clearcoat materials for producing such highly scratch-resistant clearcoats are organically modified ceramic materials, which are also sold under the brand name ORMOCER®.

Except for the application of the electrocoat material, the coating materials described above may be applied by any customary application method, such as spraying, knife coating, brushing, flow coating, dipping, impregnating, trickling or rolling, for example. The substrate to be coated (the integrated body or cabin and also the replacement part or add-on part) may itself be at rest, with the application equipment or unit being moved. Alternatively, the substrate to be coated may also be moved with the application unit being at rest relative to the substrate or being moved appropriately. The choice of which method to use is guided primarily by the size of the substrate. For instance, such a large substrate as a cabin for commercial vehicles will primarily be coated by means of movable application equipment.

Preference is given to employing spray application methods, such as compressed air spraying, airless spraying, high-speed rotation, electrostatic spray application (ESTA), for example, alone or in conjunction with hot spray applications such as hot air spraying, for example. Application may be carried out at temperatures of max. 70 to 80° C., so that suitable application viscosities are achieved without any changing or damage to the coating material and its overspray, which may be intended for the processing, during the short period of thermal load. For instance, hot spraying may be configured such that the coating material is heated only very shortly in, or shortly before, the spray nozzle.

The spray booth used for the application may be operated, for example, with an optionally temperature-controllable circulation system which is operated with an appropriate absorption medium for the overspray, e.g., with the coating material itself.

Where the coating material includes constituents which can be crosslinked by actinic radiation, application is conducted under illumination with visible light with a wavelength of above 550 nm or in the absence of light. This prevents material changing or damage to the coating material and the overspray.

In general, the electrically conductive aqueous primer film and the pale aqueous primer film, the basecoat film and the clearcoat film are applied in a wet film thickness such that curing thereof results in coats having the coat thicknesses which are advantageous and necessary for their functions. In the case of the electrically conductive aqueous primer coat and the pale aqueous primer coat, this film thickness is from 10 to 150 μm, preferably from 15 to 120 μm, with particular preference from 20 to 100 μm, and in particular from 25 to 90 μm; in the case of the basecoat it is from 5 to 50 μm, preferably from 10 to 40 μm, with particular preference from 12 to 30 μm, and in particular from 15 to 25 μm; and in the case of the clearcoat it is from 10 to 100 μm, preferably from 15 to 80 μm, with particular preference from 20 to 70 μm, and in particular from 25 to 60 μm.

Thermal curing may take place after a certain rest period. This period may have a duration of from 30 s to 2 h, preferably from 1 min to 1 h, and in particular from 1 min to 45 min. The rest period serves, for example, for the leveling and devolatilization of the paint films or for the evaporation of volatile constituents such as solvents. The rest period may be assisted and/or shortened by the application of elevated temperatures up to 90° C. and/or by a reduced air humidity <10 g water/kg air, particularly <5 g/kg air, provided th is does not entail any damage to or change in the paint films, such as premature complete crosslinking.

The thermal curing has no special features in terms of its method but instead takes place in accordance with the customary and known methods such as heating in a forced air oven or irradiation with IR lamps. Thermal curing may also take place in stages. Thermal curing takes place advantageously at a temperature from 50 to 100° C., with particular preference from 80 to 100° C., and in particular from 90 to 100° C. for a time of from 1 min to 2 h, with particular preference from 2 min up to 1 h, and in particular from 3 min to 30 min.

Given an appropriate material composition of the coating material, the thermal curing may be supplemented by actinic radiation curing, it being possible to use, in particular, UV radiation and/or electron beams, If desired, it may be supplemented by or conducted with actinic radiation from other radiation sources. In the case of electron beams it is preferred to operate under an inert gas atmosphere. This may be ensured, for example, by supplying carbon dioxide and/or nitrogen directly to the surface of the paint film.

In the case of curing with UV radiation, as well, it is possible to operate under inert gas in order to prevent the formation of ozone.

Curing with actinic radiation is carried out employing the customary and known radiation sources and optical auxiliary measures. Examples of suitable radiation sources are high or low pressure mercury vapor lamps, with or without lead doping in order to open a radiation window up to 450 nm, or electron beam sources. The arrangement of these sources is known in principle and may be adapted to the circumstances of the workpiece and the process parameters. In the case of workpieces of complex shape such as automobile bodies, the region is not accessible to direct radiation (shadow regions) such as cavities, folds, and other structural undercuts may be cured using pointwise, small-area or all-round emitters, in conjunction with an automatic movement means for the irradiation of cavities or edges.

The equipment and conditions for these curing methods are described, for example, in R. Holmes, "U.V. and E.B. Curing Formulations for Printing Inks", Coatings and Paints, SITA Technology, Academic Press, London, United Kingdom 1984.

Curing here may take place in stages, i.e., by multiple exposure to light or actinic radiation. It may also be done alternately, i.e., by curing in alternation with UV radiation and electron beams.

Where thermal curing and actinic radiation curing are employed together (dual cure), these methods may be used simultaneously or alternately. Where the two cure methods are used alternately, it is possible, for example, to begin with thermal curing and end with actinic radiation curing. In other cases it may prove advantageous to begin and to end with actinic radiation curing. The skilled worker is able to determine the curing method especially suitable for each individual case on the basis of his or her general art knowledge, where appropriate with the assistance of simple preliminary tests.

The multicoat color and/or effect paint system of the invention obtained in particular by the process of the invention comprises the coats lying atop one another in the following order:

1) on the metal parts, a cathodically or anodically, especially cathodically, deposited and thermally cured electrocoat and also an electrically conductive aqueous primer coat and/or a pale primer coat as the primer system, and
2) on the plastic parts, an electrically conductive aqueous primer coat or an electrically conductive aqueous primer coat and a pale aqueous primer coat as the primer system, with the proviso that the integrated automobile and commercial vehicle bodies or cabins and their replacement parts and add-on parts are uniformly covered over their surface by at least one aqueous primer coat; and 3) on the primer system of the metal parts and of the plastic parts, a color and/or effect basecoat, and
4) on the basecoat, at least one clearcoat.

The multicoat color and/or effect paint system may also be provided with a highly scratch-resistant clearcoat (6).

The multicoat color and/or effect paint systems of the invention exhibit an outstanding profile of properties which is very well balanced in terms of mechanics, optics, corrosion resistance, and adhesion, even at very low temperatures and/or after condensation exposure. Accordingly, the multicoat paint systems of the invention have the high optical quality and intercoat adhesion the market requires and do not give rise to problems such as poor condensation resistance, cracking (mud cracking) in the basecoats or leveling defects or surface textures in the clearcoats.

In particular, the multicoat paint system of the invention exhibits an outstanding metallic effect, an outstanding D.O.I. (distinctiveness of the reflected image), and an outstanding surface smoothness. It is weathering stable, resistant to chemicals and bird droppings, and scratch-resistant, and shows very good reflow properties.

A further substantial advantage is the very good overcoatability of the multicoat paint system of the invention, even without sanding. Consequently, it is easy to coat with customary and known highly scratch-resistant coating materials based on organically modified ceramic materials.

It should be stressed that these advantages are obtained irrespective of whether the particular parts considered, being parts of the inventive integrated bodies of automobiles or cabins of commercial vehicles and the replacement parts and add-on parts, are overcoated metal parts or plastic parts. In other words, the complex substrates have a multicoat paint system which is of consistent and outstanding quality over the entire surface.

Not least, however, it is found to be a very particular advantage that by means of the process of the invention it is possible to realize a multicoat paint system which is based predominantly on aqueous coating materials.

Accordingly, the inventive integrated bodies of automobiles or cabins of commercial vehicles and also their replacement parts and add-on parts have a relatively long service life, a better esthetic impression on the viewer, and a greater technological usefulness, which makes them particularly attractive economically.

What is claimed is:

1. An integrated process for painting a substrate that comprises at least one metal part and at least one plastic part, a) wherein the substrate comprises at least one of i) an automobile body ii) an automobile cabin, iii) a commercial vehicle body, and/or iv) a Commercial vehicle cabin, and optionally further comprise at least one of i) an automobile body replacement part, ii) an automobile cabin replacement part, iii) an automobile body add-on part, iv) an automobile cabin add-on part, v) a commercial vehicle body replacement part, vi) a commercial vehicle cabin replacement part, vii) commercial vehicle body add-on part, and/or viii) a commercial vehicle cabin add-on part;

b) wherein the at least one metal part of the substrate is coated with an electrocoat material to form an electrocoat film and the electrocoat film is cured thermally to give a corrosion-inhibiting electrocoat;

c) wherein the electrocoated at least one metal part of the substrate is integrated with the at least one plastic part of the substrate to form an integrated metal-plastic substrate, d) wherein one of i) the at least one plastic part has no primer on its surface, ii) the at least one plastic part, on its surface, comprises a primer comprising an electrically conductive aqueous primer coating that is cured thermally at a temperature $\leqq 100°$ C., or iii) the at least one plastic part, on its surface, comprises a partially dried but not fully cured electrically conductive aqueous primer film; comprising 1) coating the integrated metal-plastic substrate with an aqueous primer, wherein coating comprises one of
   a) coating uniformly, when the at least one plastic part has no primer, the integrated metal-plastic substrate with an electrically conductive aqueous primer and curing the resulting electrically conductive aqueous primer film at a temperature ≦100° C. to give a two-coat primer system comprising electrocoat and electrically conductive primer coat on the at least one metal part and a single-coat primer system comprising electrically conductive primer coat on the at least one plastic part, wherein the electrically conductive pigment, and at least one component II comprising at least one polyisocyanate;
   b) coating uniformly, when the at least one plastic part has the primer comprising an electrically conductive aqueous primer coating, the integrated metal-plastic substrate with an aqueous primer having a color that is matched to a color of an aqueous basecoat material and curing the resulting bright aqueous primer film at a temperature ≦100° C. to give a two-coat primer system comprising electrically conductive primer coat and a primer coat having a color that is matched to a color of a basecoat on the at least one plastic part and a two-coat primer system comprising electrocoat and a primer coat having a color that is matched to a color of a basecoat on the at least one metal part; or
   c) coating uniformly, when the at least one plastic part has the partially dried electrically conductive aqueous primer film, the integrated metal-plastic substrate, wet-on-wet in terms of the at least one plastic part, with an aqueous primer having a color that is matched to a color of an aqueous basecoat material, and jointly curing the electrically conductive aqueous primer film and the aqueous primer film having a color that is matched to a color of a basecoat at a temperature ≦100° C. to give a two-coat primer system comprising electrically conductive primer coat and a primer coat having a color that is matched to a color of a basecoat on the at least one plastic part and a two-coat primer system comprising electrocoat and a primer coat having a color that is matched to a color of a basecoat on the at least one metal part;
2) one of
   a) applying the aqueous basecoat material uniformly to the primer systems of 1) b) or 1) c) and partially drying without curing the resulting aqueous basecoat film, wherein the basecoat material is one of i) a color basecoat material, ii) an effect basecoat material, or iii) a color and effect basecoat material, or
   b) applying an aqueous basecoat material uniformly to the primer systems of 1) a) and partially drying without curing the resulting aqueous basecoat film, wherein the basecoat material is one of i) a color basecoat material, ii) an effect basecoat material, or iii) a color and effect basecoat material;
3) applying wet-on-wet at least one two-component clearcoat material to the partially dried aqueous basecoat film to give at least one clearcoat film; and
4) jointly curing at temperatures ≦100° C., by one of i) thermally and ii) thermally and with actinic radiation, the partially dried aqueous basecoat film and the at least one clearcoat film to give an integrated multicoat paint system, wherein the multicoat paint system is one of i) a multicoat color paint system, ii) a multicoat effect paint system, and iii) a multicoat color and effect paint system.

2. The process of claim 1, wherein the integrated metal-plastic substrate is formed by the process comprising precisely positioning the at least one plastic part of the substrate on an assembly stage, and placing the at least one electrocoated metal part of the substrate on the assembly stage.

3. The process of claim 1 further comprising in the coating step, where the at least one plastic part has no primer, one of:
   a) applying an aqueous primer having a color that is matched to a color of an aqueous basecoat material uniformly to the cured electrically conductive primer coat and curing the resulting aqueous primer coat thermally at a temperature ≦100° C. and
   b) prior to curing the electrically conductive aqueous primer, partially drying the electrically conductive aqueous primer and applying an aqueous primer having a color that is matched to a color of an aqueous basecoat material wet-on-wet to the partially dried electrically conductive aqueous primer film, and then jointly curing at a temperature ≦100° C. the electrically conductive aqueous primer film and the resulting primer film having a color that is matched to a color of an aqueous basecoat material, so as to result in a three-coat primer system comprising electrocoat, electrically conductive primer coat, and primer coat having a color that is matched to a color of a basecoat on the at least one metal part and a two-coat primer system comprising electrically conductive primer coat and primer coat having a color that is matched to a color of a basecoat on the at least one plastic part.

4. The process of claim 1, wherein the electrocoat material comprises a lead-free cathodically depositable electrocoat material comprising at least one epoxy-amine adduct.

5. The process of claim 1, wherein the electrically conductive aqueous primer of d) ii), and/or d) iii) comprise a component I comprising at least one aqueous polyurethane dispersion and at least one electrically conductive pigment, and at least one component II comprising at least one polyisocyanate.

6. The process of claim 5, wherein the electrically conductive pigment comprises carbon black.

7. The process of claim 1, wherein the aqueous primer having a color that is matched to a color of an aqueous basecoat material of 1) b) and 1) c) each comprise a component I comprising at least one hydroxyl-containing binder in dispersion or solution in water and at least one bright pigment, and a component II comprises at least one polyisocyanate.

8. The process of claim 7, wherein the hydroxyl-containing binder comprises at least one of a polyester, a polyacrylate, a polyurethane, an acrylated polyester, and an acrylated polyurethane.

9. The process claim 1, wherein the aqueous basecoat material comprises at least one hydroxyl-containing binder in dispersion or solution in water and at least one of a color pigment, an effect pigment, and a color and effect pigment.

10. The process of claim 9, wherein the aqueous basecoat material comprises a hydroxyl-containing binder comprising at least one of a polyurethane and an acrylated polyurethane.

11. The process of claim 9, wherein the aqueous basecoat material further comprises at least one of a hydroxyl-containing polyacrylate, a hydroxyl-containing polyester, and a hydroxyl-containing acrylated polyester.

12. The process of claim 1, wherein the aqueous basecoat material comprises at least one crosslinking agent.

13. The process of claim 1, wherein the two-component clearcoat material comprises a component I having at least one hydroxyl-containing binder and a component II having at least one polyisocyanate.

14. The process of claim 1, wherein the two-component clearcoat material is curable both thermally and with actinic radiation.

15. The process of claim 1, wherein the cured two-component clearcoat material is overcoated with a scratch-resistant clearcoat.

16. The substrate formed by the process of claim 1.

17. An integrated multicoat paint system on an integrated metal-plastic substrate that comprises at least one metal part and at least one plastic part, a) wherein the multicoat paint system is one of i) a multicoat color paint system, ii) a multicoat effect paint system, and iii) a multicoat color and effect paint system;

b) wherein the substrate comprises at least on of i) an automobile body ii) an automobile cabin, iii) a commercial vehicle body, and/or iv) a commercial vehicle cabin, and optionally further comprise at least one of i) an automobile body replacement part, ii) an automobile cabin replacement part, iii) an automobile body add-on part, iv) an automobile cabin add-on part, v) a commercial vehicle body replacement part, iv) a commercial vehicle cabin replacement part, vii) a commercial vehicle body add-on part, and/or viii) a commercial vehicle cabin add-on part;

comprising coats lying atop one another in sequence:

1) a primer system comprising:

a. on the at least one metal part, a metal primer system comprising a cathodically or anodically deposited and thermally cured electrocoat and at least one of an electrically conductive primer coat and a primer coat having a color that is matched to a color of a basecoat on the cured electrocoat, wherein the entire surface of the at least one metal part is coated with the metal primer system, and b. on the at least one plastic part, a plastic primer system comprising an electrically conductive primer coat on the plastic part and a primer coat having a color that is matched to a color of a basecoat on the electrically conductive primer coat, wherein the entire surface of the at least one plastic part is coated with the plastic primer system, 2) on the primer system, the basecoat of 1) a) or 1) b), wherein the basecoat is one of i) a color basecoat, ii) an effect basecoat, and iii) a color and effect basecoat, and 4) on the basecoat, at least one clearcoat.

18. The integrated multicoat paint system of claim 17, wherein the clearcoat comprises a scratch-resistant clearcoat.

* * * * *